US007044866B1

(12) United States Patent
Blauvelt

(10) Patent No.: US 7,044,866 B1
(45) Date of Patent: May 16, 2006

(54) GOLF TEE MARKING TEMPLATE

(76) Inventor: Edward J. Blauvelt, P.O. Box 432, New Haven, IN (US) 46774

( * ) Notice: Subject to any disclaimer, the term of this patent is extended or adjusted under 35 U.S.C. 154(b) by 0 days.

(21) Appl. No.: 10/449,472

(22) Filed: May 30, 2003

(51) Int. Cl.
*A63B 57/00* (2006.01)

(52) U.S. Cl. ..... 473/386; 33/485; 224/918

(58) Field of Classification Search ..... 473/386–403; 224/918; 33/483, 485
See application file for complete search history.

(56) References Cited

U.S. PATENT DOCUMENTS

| | | | | |
|---|---|---|---|---|
| 656,413 | A * | 8/1900 | Meux | 33/485 |
| 3,658,331 | A * | 4/1972 | Driscoll | 473/386 |
| 4,982,510 | A * | 1/1991 | Musillo | 473/386 |
| 5,735,758 | A * | 4/1998 | Miketinac | 473/386 |
| 6,691,905 | B1 * | 2/2004 | Berdan | 224/918 |

* cited by examiner

*Primary Examiner*—Steven Wong

(57) ABSTRACT

A marking template used to mark or etch golf tees at selected distances from the ends of the golf tee, and a process for marking golf tees. The template comprises a body having a receptacle into which a golf tee is placed. The golf tee is then marked at distances selected according to the markings on the body.

2 Claims, 2 Drawing Sheets

GOLF TEE MARKING TEMPLATE

FIELD OF THE INVENTION

This invention is a template or scale made specifically for conveniently marking a tee used in the game of golf. A golfer would use this template to mark his tee at a predetermined height and use that mark as a reference point when teeing his/her ball in the ground.

BACKGROUND OF THE INVENTION

For more than 50 years, golfers and golf equipment manufacturers have strived to develop a convenient way to tee the golf ball a consistent height. First attempts were made by tee makers. Tees were made with a shoulder or step on the shaft a fixed distance from the top of the tee. This made the tee height consistent but it had 2 flaws. That fixed height had to be right for everyone, which was undesirable, and the shoulder created a weak spot in the tee which results in the tee breaking, usually after one use.

Then came the inventions by Driscoll U.S. Pat. No. 3,658,331, Musillo U.S. Pat. No. 4,982,510 and Miketinac U.S. Pat. No. 5,735,758. As described in each patent, these inventions incorporate a tool which is actually used in the placement of a tee into the ground. This requires the golfer to carry the tool in his bag or pocket during the round of golf. Upon teeing the ball at each hole, the player must remove the tool from his pocket, insert the tee in the tool, place the tee in the ground, return the tool to his pocket, then place his/her ball on the tee. This whole process requires extra time teeing the ball, thus slowing down play which is frowned upon in the game of golf.

Another shortcoming of these inventions is that many golfers prefer their pockets be as empty as possible while playing a round of golf. Things like, keys, coins, lighters etc . . . , can be an annoyance when making a golf swing. Many would find the tool an annoyance for this reason and others would just be too embarrassed to use such a tool in front of there comrades.

A golfer could simply use a standard ruler to mark his/her tees, with say, a pen or marker, to have a reference point to control the depth he/she places his/her tee in the ground, but due to the shape of a golf tee, this is a bit awkward or cumbersome.

SUMMARY OF THE INVENTION

It is an object of this invention, to provide a golfer a simple convenient means, prior to a round of golf, to mark a reference point, on the tees he/she intends to use while playing the game of golf. The purpose of the reference point is to maintain a consistent tee height when placing the tee in the ground.

It is a further object of the invention to give the golfer full flexibility in the height he/she personally prefers to tee the ball.

In order to achieve the above objectives, a golf tee template can be used. A preferred embodiment would be made of a suitably rigid material, rectangular in shape and approximately 1/16" thick. The primary features of the template will include, a cutout or slot, generally resembling the shape of a commonly used golf tee, and a standard measuring scale. The overall length of the cutout will be long enough to receive any commonly used length of golf tee. The flared end of the cutout, which resembles the head of a golf tee, will be larger than the head of a commonly used golf tee. The long narrow shank of the slot will be smaller than the shank of a commonly used golf tee, providing a nesting surface. Thus, the tee will nest flat on its shank, parallel to the surface of the embodiment, and will be free to slide in the direction of the centerline of the cutout. On the surface of the template, a measuring scale will be impressed, adjacent to, the full length of the cutout, with the zero mark being, perpendicular to, the centerline of the cutout and, in line, with the edge of the cutout, that resembles and represents, the top surface of the golf tee head. While holding the template in one hand, the golfer will place a tee in the template. Using the thumb of the same hand the golfers can slide the tee against the "zero" end of the cutout, and using their free hand, mark the tee at the desired increment, representing the preferred height they wish to tee the ball. The preferred height can be determined through practice or trial and error.

DETAILED DESCRIPTION OF SEVERAL EMBODIMENTS

The disclosed inventions relate generally to a marking template for a golf tee that allows for marking a golf tee at selected distances from one end of the golf tee.

Figure 1:
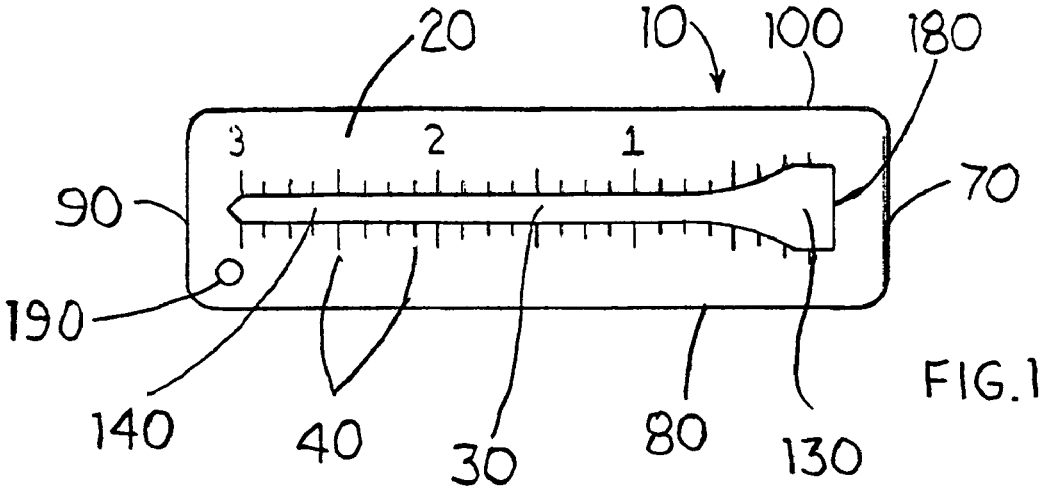
FIG. 1 shows a top view of one version of the golf tee marking template having a rectangular body.
Figure 5:
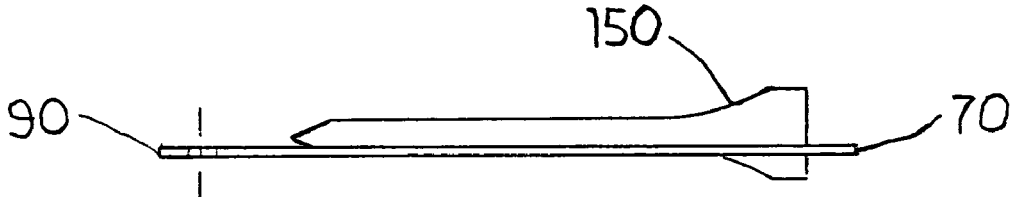
FIG. 5 is a side view of the golf tee marking template of FIG. 1.

Referring to FIG. 1, the golf tee marking template 10 comprises a body 20, a receptacle 30 and a plurality of markings 40. In one version, the body will have a top side 50, a bottom side 60, and at least three edges, 70, 80, 90. In another version, the body 20 has four edges 70, 80, 90, 100 thereby forming a square or rectangular body 20.

Figure 4:
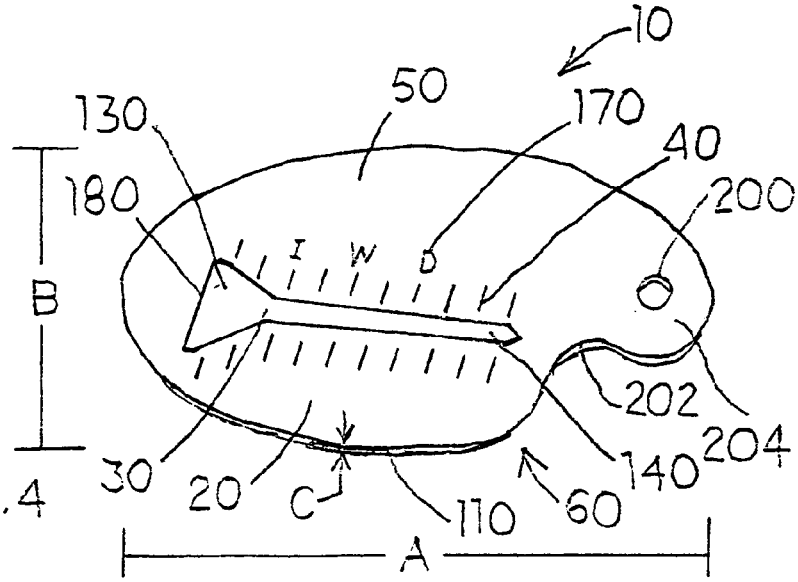
FIG. 4 shows a perspective view of a version of the golf tee marking template having a curvilinear body.

In another version, the body 20 is generally circular, oval, elliptical or any other enclosed curvilinear geometric shape as shown in FIG. 4. In the versions in which the body 20 is generally circular, oval, elliptical or curvilinear, the body will have one continuous edge 110 extending around the body 20. A top side 50 and a bottom side 60.

The body 20 may be manufactured from any rigid or semi-rigid material. In one version, the body 20 comprises plastic. In another version, the body 20 comprises wood. In yet another version, the body 20 comprises metal. The body 20 is made of a sheet material. The body has at least three dimensions, namely a longest dimension A, a second dimension B transverse to the longest dimension and a thickness C. In one version, the longest dimension is at least about 3 inches, the second dimension is at least about 1 inch, and the thickness is at least about 1/16 inch. The general size of the body 20 is dictated by the minimum size of the receptacle 30 needed to receive a golf tee. Golf tees exist in various sizes and that the body 20 may be larger than the dimensions described above in order to provide a receptacle 30 capable of receiving golf tees of varying sizes.

Referring to FIGS. 1, 2, 4 and 5, the receptacle 30 is shaped generally to accept a golf tee. In one version, the receptacle 30 comprises an opening through the body 20 extending from the top side 50 through the bottom side 60. In another version, the receptacle 30 comprises a depression 120 in either the top side 50 or the bottom side 60 of the body 20, in which the golf tee may rest without passing through the body 20. See FIGS. 2 and 3. In one version, the depression has a depth of about the radius of a cross-section of a golf tee. In another version, the depression has a depth of less than the radius of a golf tee.

The receptacle 30 will comprise a flared end 130 and a narrow end 140 that correspond generally to the shape of a golf tee 150. In one version, the flared end has a top end 180. The flared end 130 is at least about 0.45 of an inch wide, and at least about 0.75 inches long. In one version, the flared end 130 is positioned about 0.25 of an inch from a first edge 70 of the body 20. In one version, the narrow end 140 of the receptacle 30 is about 0.13 of an inch wide. In yet another version, the narrow end 140 is positioned at least about 0.18 of an inch from a third edge 90 of the body 20.

The receptacle 30 has a center line 160. The receptacle 30 is geometrically identical about the center line 160. Markings 40 are located on either or both of the sides 50, 60. The markings 40 are placed generally perpendicular to the centerline 160. The markings 40 are spaced at selected intervals along at least one side of the center line 160. In one version, the markings 40 are spaced at selected intervals along both sides of the center line 160. In another version, the markings 40 are spaced at uniform intervals. In one version, a marking 40 is placed 0.5 of an inch from the top end 180. In another version, a marking 40 is placed 1 inch from the top end 180. In another version, similar markings 40 will be at 1.5 and 2 inches from the top end 180 of the receptacle. In other versions, the markings 40 may be spaced at any desired distance from the top end 180 without varying from the scope of this description.

At least one of the markings 40 may have a symbol 170 corresponding to it. The symbol 170 corresponds to a selected distance, the distance being the distance from that marking 40 to the top end 180 of the receptacle. The symbols 170 are provided on the body 20 in proximity to the markings 40. In one version, the symbols may be integers or fractions denoting the distance from that marking to the top of end 180. In one version, the integers and fractions denote the distance in Standard English measurements. In another version, the integers and fractions denote the distances in metric measurements.

In yet other versions, the symbols 170 may comprise letters. In one version, the symbols comprise at least one letter. In one version, the letters are "D" denoting "driver," the letter "W" denoting "wood," and the letter "I" denoting "iron". The symbols "D," "W," and "I," will be arranged on the top or bottom 50, 60 so that "I" is closer to the flared end 180 than "W" or "D," and so that "W" is closer to the top of the flared end 180 than the symbol "D." In another version, the letters may spell selected words, such as "driver," "wood," or "iron." In one version, the words are "brassie," "spoon," and "mashie."

Figure 2:
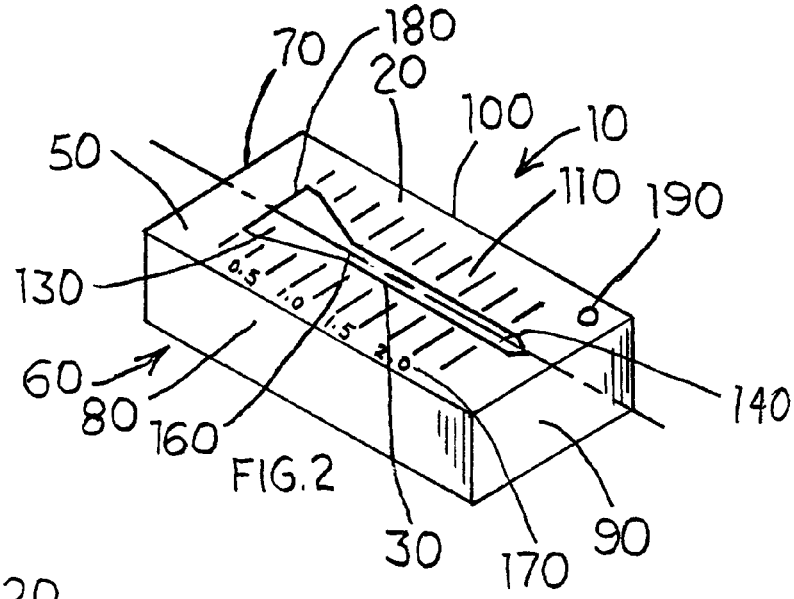
FIG. 2 shows a perspective view of another version of the golf tee marking template.
Figure 3:
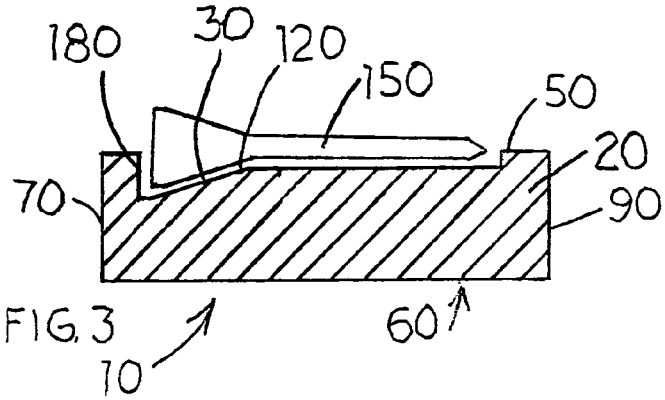
FIG. 3 shows a cross-sectional view of the version shown in FIG. 2.

In one version, the body 20 has a means 190 for securing the body 20 to an article, such as a golf bag, golf cart or belt. In one version, the means comprises a hole 190, as shown in FIG. 2, through which a tether, string, chain or the like is passed. In another version, the means comprise a hole 200 as shown in FIG. 4. The tether may then secure the body 20 to the article.

In other versions, a handle 204 is defined to render the template 10 more convenient to use. As shown in FIG. 4, a notch 202 is formed in the body 20 to define handle 204.

While specific versions of the disclosed invention have been shown and described for the purpose of illustration, the protection offered by any patent which may issue upon this application is not limited to the disclosed embodiments. Rather, the protection extends to all structures, arrangements and processes falling fairly within the scope of the claims appended hereto. One of ordinary skill in the art will recognize that the size, shapes and dimensions of the golf tee marking templates described herein may be varied without departing from the scope of the disclosure or the accompanying claims.

What is claimed is:

1. A golf tee marking template used for marking a golf tee at the users desired tee height, comprising a body of suitably rigid sheet material, having a length of about 3.5" and a width of about 1" and a thickness of about 1/16', with a receptacle, in the form of a cutout or slot, having the general shape of a golf tee, wherein the cutout is fully enclosed by a common surface of the body, the cutout comprising a flared end and a narrowed shaft end, the cutout will be bordered by an incremental scale on both sides, impressed in the common surface and adjacent to the full length of the cutout, the "reference" or "zero" point of the scale will be the edge of the cutout representing the top of a golf tee.

2. The template of claim 1, wherein the body comprises a means for securing the body to an article.

* * * * *